US006371190B1

(12) United States Patent
Owens

(10) Patent No.: US 6,371,190 B1
(45) Date of Patent: Apr. 16, 2002

(54) DECOR UNIT AND METHOD FOR MOUNTING SAME ON A WALL

(76) Inventor: Rene D. Owens, 5502 E. Charter Oak Rd., Scottsdale, AZ (US) 85254

( * ) Notice: Subject to any disclaimer, the term of this patent is extended or adjusted under 35 U.S.C. 154(b) by 0 days.

(21) Appl. No.: 09/595,091

(22) Filed: Jun. 16, 2000

(51) Int. Cl.[7] ..... A47G 5/00

(52) U.S. Cl. ..... 160/135; 160/351; 160/370.23

(58) Field of Search ..... 160/19, 38, 39, 160/135, 330, 370.21, 370.22, 370.23, 351, 405

(56) References Cited

U.S. PATENT DOCUMENTS 4,711,046 A * 12/1987 Herrgord ..... 40/605
4,821,349 A * 4/1989 Cohen ..... 5/53 R
4,999,874 A * 3/1991 White ..... 16/95 D
5,324,090 A * 6/1994 Lehnhoff ..... 296/95.1
5,503,209 A * 4/1996 Healzer et al. ..... 160/38
5,506,020 A * 4/1996 Haberkorn ..... 428/102
5,584,330 A * 12/1996 Muller ..... 160/135
5,692,554 A * 12/1997 Huang ..... 160/370.23
5,894,923 A * 4/1999 Hamstra et al. ..... 206/232
5,960,848 A * 10/1999 Schirer ..... 160/135
6,017,094 A * 1/2000 Syiek ..... 297/482
6,092,584 A * 7/2000 Humphries ..... 160/370.23
6,155,325 A * 12/2000 Schirer ..... 160/135
6,182,307 B1 * 2/2001 Rutrick ..... 5/53.1

* cited by examiner

*Primary Examiner*—Bruce A. Lev
(74) *Attorney, Agent, or Firm*—Tod R. Nissle, P.C.

(57) ABSTRACT

A kit for assembly into a wall-mounted decor unit. The kit includes a laminate board, a fabric cover, and fasteners for attaching the laminate board to a wall. The laminate board includes sections folded in zig-zag fashion along lines of weakening. The sections of the laminate board can only be folded away from the lines of weakening. The fabric cover is slidably, removably mounted on the laminate board after the laminate board is unfolded and mounted on a wall.

4 Claims, 5 Drawing Sheets

FIG. 4
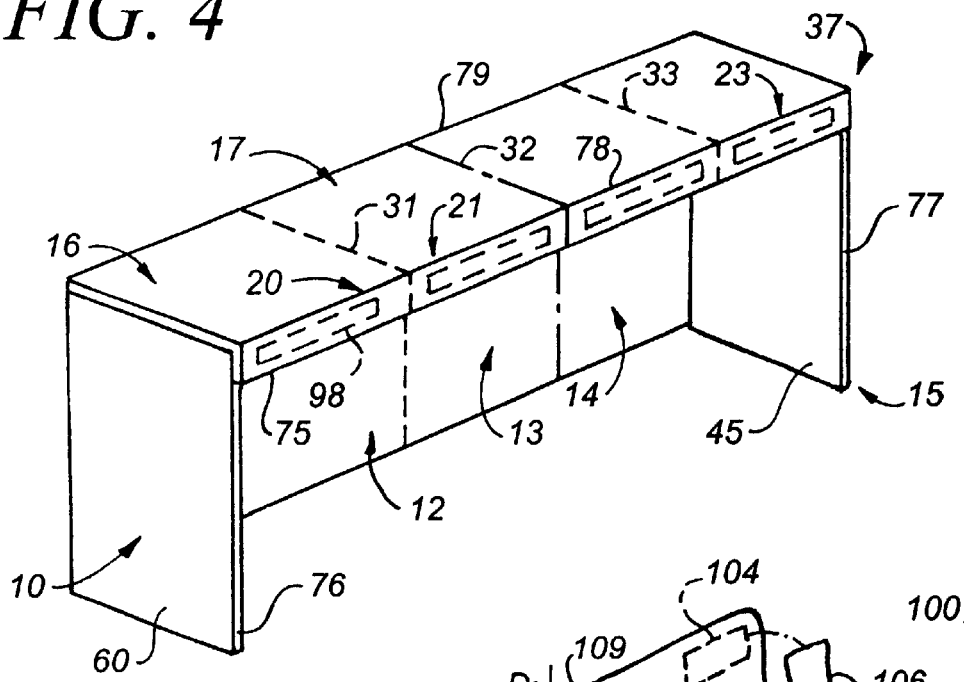
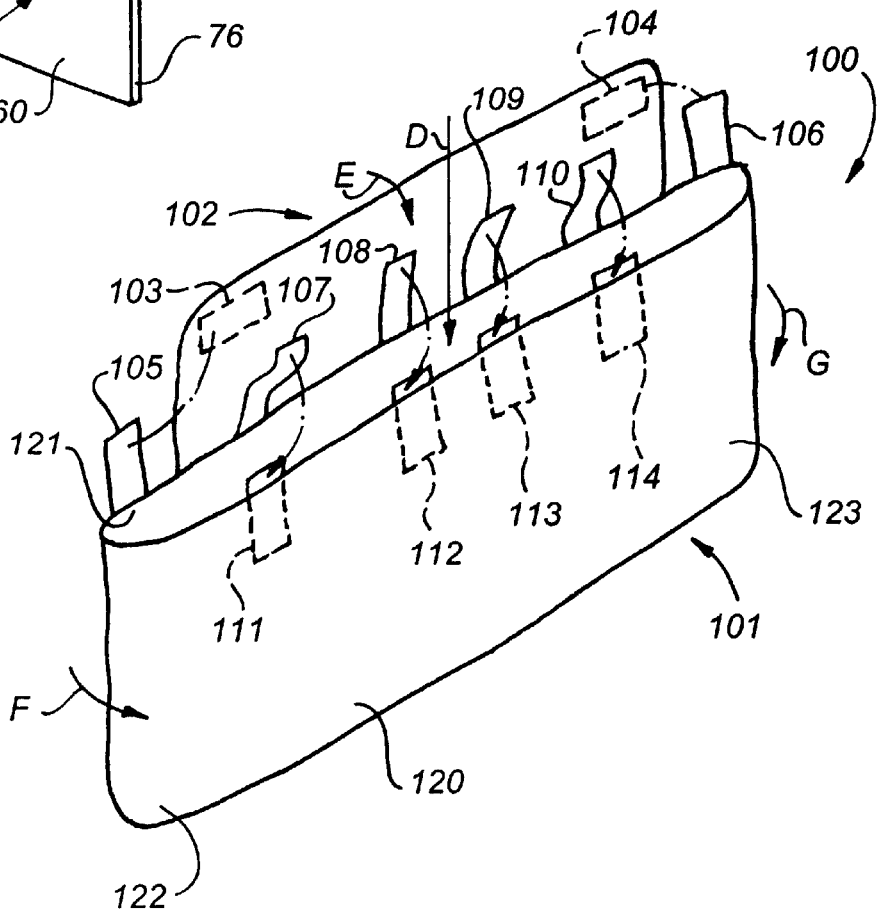
FIG. 5

FIG. 6
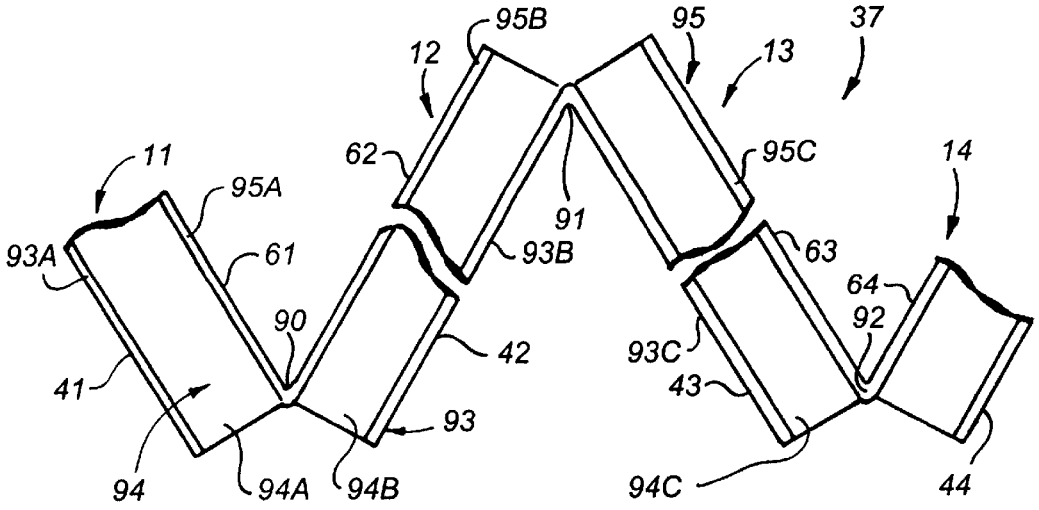
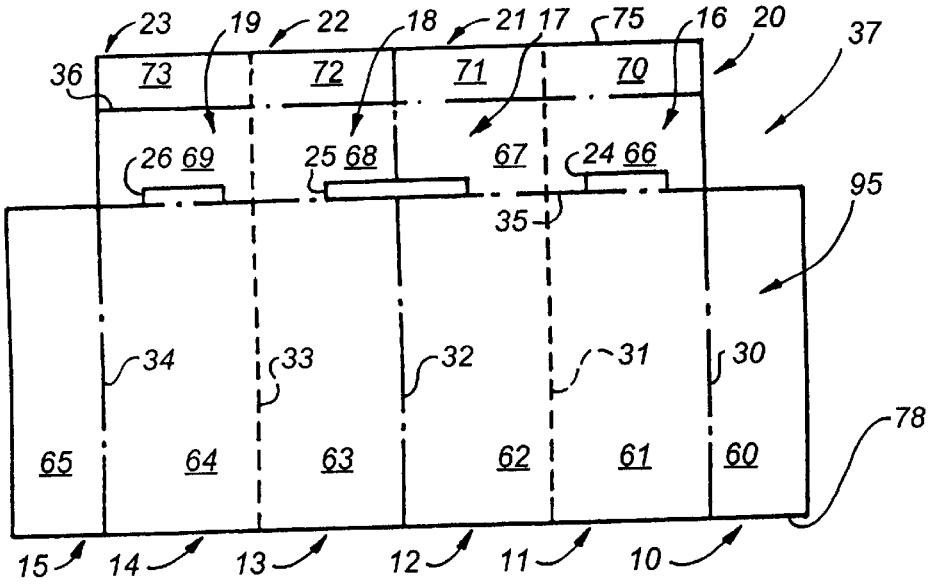
FIG. 7

DECOR UNIT AND METHOD FOR MOUNTING SAME ON A WALL

This invention relates to decor units such as bed head boards, wall decorations, corner beads, cornices, signage, displays, and methods for making and installing the same.

More particularly, the invention relates to a method and apparatus for putting a decor unit in a small package, for making a lightweight decor unit, for assembling a decor unit with a removable fabric cover for cleaning, and for scoring a decor unit in a manner which facilitates packaging the decor unit.

U.S. Pat. No. 5,503,209 to Healzer et al. describes a paperboard stock material which is folded into a valance. Tape or an adhesive coating is used to attach a covering of fabric, paper, ribbons, lace or other material to the valance. The Healzer et al. valance has potential disadvantages. First, to insure that the folded paperboard remains assembled, Healzer et al. utilize a system of notches and grooves. Second, the Healzer et at. valance utilizes fabric and other material which is permanently attached to the valance and can not be readily removed for cleaning. Third, the Healzer et al. valance occupies, prior to being assembled, a substantial amount of storage space at least equal to the length of the valance. The paperboard blank utilized in Healzer et al. lays flat until the valance is assembled. Fourth, the Healzer et al. assembly is intended for use solely as a valance and is not adapted to function in another manner.

Accordingly, it would be highly desirable to provide an improved method and apparatus which would include a board structure, which did not have to be interlocking or utilize other fasteners, which would include fabric that could be readily removed and cleaned separately from the board structure, which would require a small storage space, and which could be readily adapted for use as various kinds of decor units.

Therefore, it is a principal object of the invention to provide an improved method and apparatus for making a decor unit.

Another object of the invention is to provide an improved decor unit apparatus which can be stored in a compact configuration prior to assembly of the apparatus.

A further object of the invention is to provide an improved decor unit apparatus which utilizes a substantially stiff board which does not, when assembled, have to interlock or have to utilize fasteners to hold the board together.

Still another object of the invention is to provide an improved decor unit including a fabric covering which can be readily removed for cleaning without requiring modification of the board forming the support structure for the decor unit.

Yet another object of the invention is to provide an improved decor unit which can be adapted to serve various functions.

These and other, further and more specific objects and advantages of the invention will be apparent to those skilled in the art from the following detailed description thereof, taken in conjunction with the drawings, in which:

FIG. 4 is a perspective view of the laminate board of FIG. 3 after the board has been completely refolded into a decor unit configuration;

FIG. 5 is a perspective view of a removable pliable fabric cover which is mounted on the board of FIGS. 1 to 4, 6, 7;

FIG. 6 is a bottom view of the board of FIGS. 1 and 2 when the board is being unfolded from the folded zig-zag configuration of FIG. 1 to the flat configuration of FIG. 2;

FIG. 7 is a back view of the board of FIG. 2; and,

Figure 1:
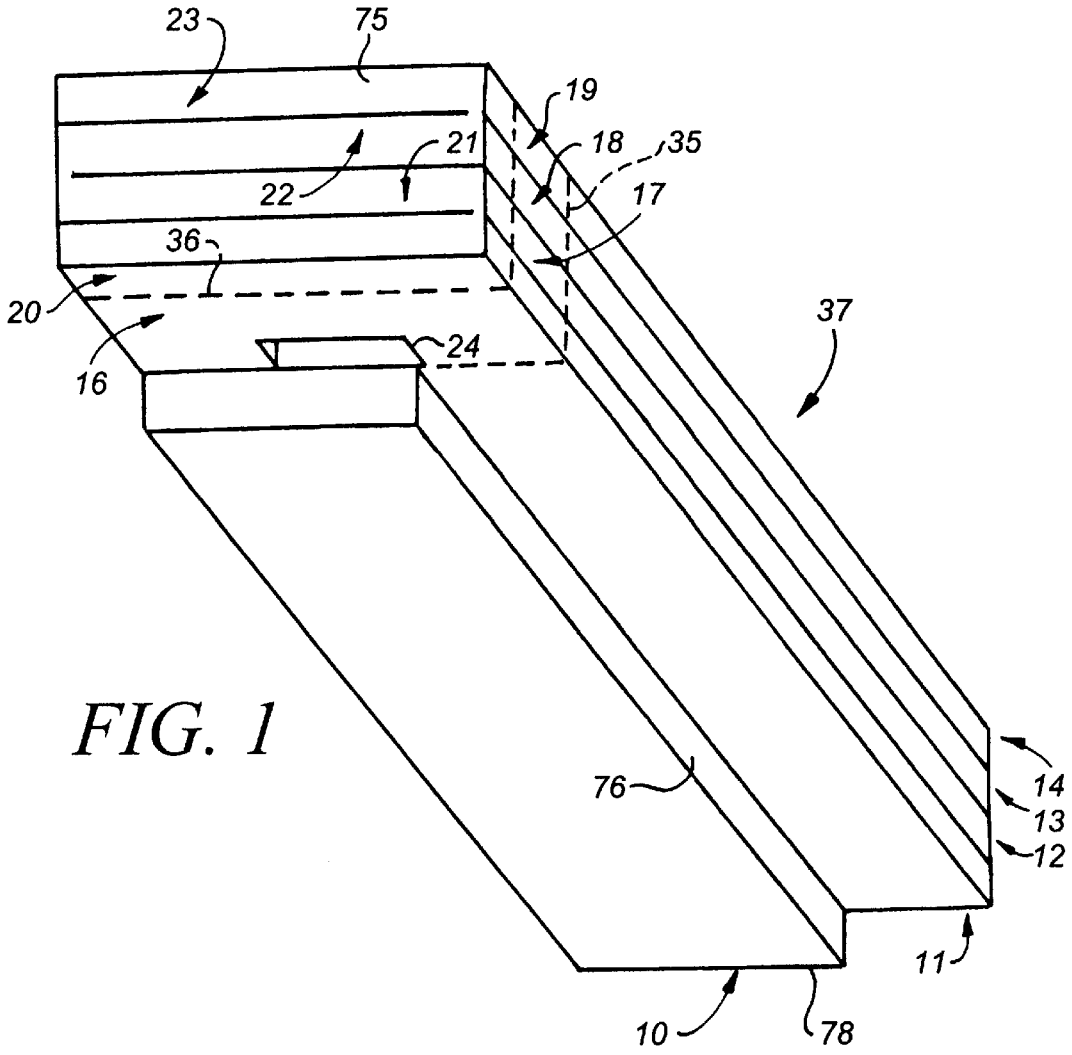
FIG. 1 is a perspective view of the laminate board of the invention in a compact folded storage configuration.

Briefly, in accordance with the invention, I provide an improved decor kit. The kit includes a laminate board including a front layer, an outer front surface on the front layer, a back layer, an outer back surface on the back layer, at least one stiffening layer intermediate the front and back layers, at least one frontal line of weakening formed on the front surface and extending through the front layer and at least a portion of the stiffening layer, at least one rear line of weakening formed on the back surface and extending through the back layer and at least a portion of the stiffening layer, and at least one opening formed through the laminate board. The frontal and rear lines of weakening are parallel and shaped and dimensioned such that the laminate board is foldable along the lines of weakening in zig-zag fashion. The decor unit also includes a fabric cover for the laminate board. The cover includes at least one pocket shaped and dimensioned to fit over at least a portion of the laminate board, and fastening apparatus attached to the cover and shaped and dimensioned to extend through the opening to secure the cover to the laminate board.

In another embodiment of the invention, I provide an improved decor kit. The kit includes a board including a front surface,a back surface, and at least one opening formed through the laminate board. The kit also includes a fabric cover for the board. The cover includes at least one pocket shaped and dimensioned to fit over at least a portion of the board, and fastening apparatus attached to the cover and shaped and dimensioned to extend through the opening to secure removably the cover to the board. The kit also includes apparatus for fastening the board to a wall such that the fabric cover can be removed from the board while the board is fastened to the wall.

In a further embodiment of the invention, I provide an improved decor kit. The kit includes a laminate board including a front layer, an outer front surface on the front layer, a back layer, an outer back surface on the back layer, at least one stiffening foam layer intermediate the front and back layers, at least one frontal line of weakening formed on the front surface and extending through the front layer and at least a portion of the foam stiffening layer, at least one rear line of weakening formed on the back surface and extending through the back layer and at least a portion of the foam stiffening layer, and at least one opening formed through the laminate board. The frontal and rear lines of weakening are parallel and shaped and dimensioned such that the laminate board is foldable along the lines of weakening in zig-zag fashion. The kit also includes a fabric cover for the laminate board. The cover includes at least one pocket shaped and dimensioned to fit over at least a portion of the laminate board, and includes fastening apparatus attached to the cover and shaped and dimensioned to extend through the opening to secure the cover to the laminate board.

Turning now to the drawings, which describe the presently preferred embodiments of the invention for the purpose of describing the practice thereof and not by way of limitation of the scope of the invention, and in which like reference characters refer to corresponding elements throughout the several views, FIG. 1 illustrates a substantially stiff board 37 folded into a compact storage configuration and including interconnected foldable rectangular panels 10 to 14, 16 to 23. Rectangular panel 15 is not visible in FIG. 1 but can be seen in FIGS. 2, 3, 4, 7. Panels 10 and 15 are side panels. Panels 16 to 19 are top panels. Panels 20 to 23 are auxiliary top panels which fold to become back panels when board 37 is folded to form the decor unit illustrated in FIG. 4. Rectangular openings 24 to 26 are formed through board 37. The shape and dimension of openings 24 to 26 can vary as desired. The number of and shape and dimension of panels 10 to 23 can vary as desired.

Panel 10 includes front 40 and back 60. Panel 11 includes front 41 and back 61. Panel 12 includes front 42 and back 62. Panel 13 includes front 43 and back 63. Panel 14 includes front 44 and back 64. Panel 15 includes front 45 and back 65. Panel 16 includes front 46 and back 66. Panel 17 includes front 47 and back 67. Panel 18 includes front 48 and back 68. Panel 19 includes front 49 and back 69. Panel 20 includes front 50 and back 70. Panel 21 includes front 51 and back 71. Panel 22 includes front 52 and back 72. Panel 23 includes front 53 and back 73.

Board 37 can be fabricated out of any desired material. The presently preferred board 37, however, is a lightweight laminate that is about 0.25" thick and includes outer front layer 93 and outer back layer 95 of paper or cardboard glued or otherwise attached to a central stiffening foam core 94. The foam core is presently preferably polystyrene or polyurethane foam or another polymer foam but can consist of any desired foam material. Outer layers 93 and 95 can be fabricated from any desired material, as can core 94.

The presently preferred paper—foam—paper laminate board 37 is lightweight, yet substantially stiff or rigid.

Figure 2:
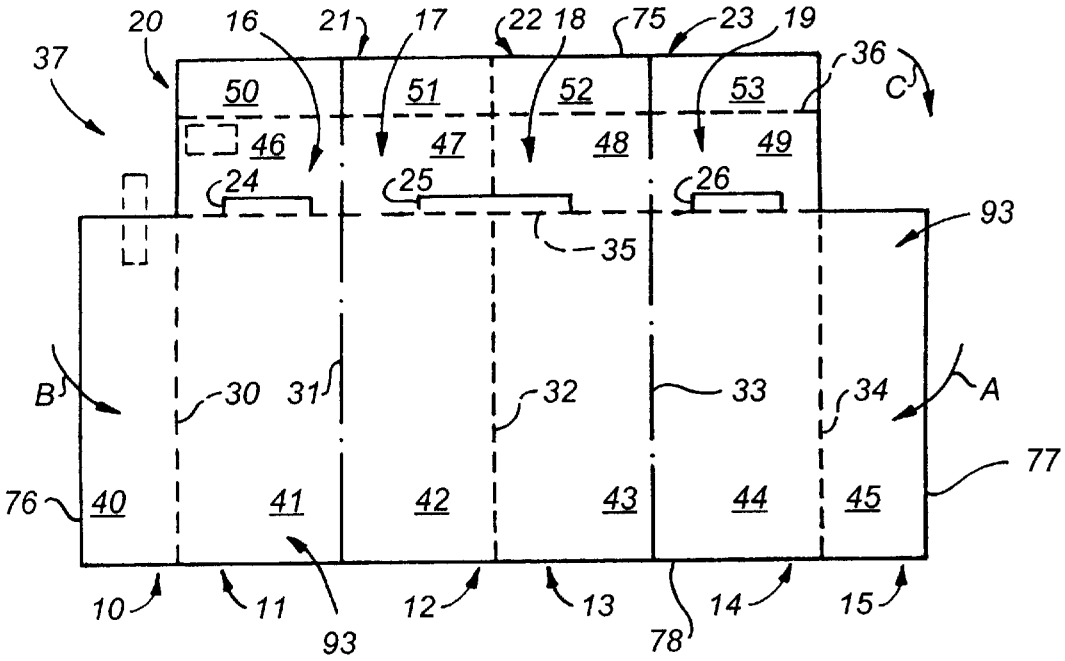
FIG. 2 is a front view of the laminate board of FIG. 1 after the board is unfolded from the storage configuration and laid flat.
Figure 3:
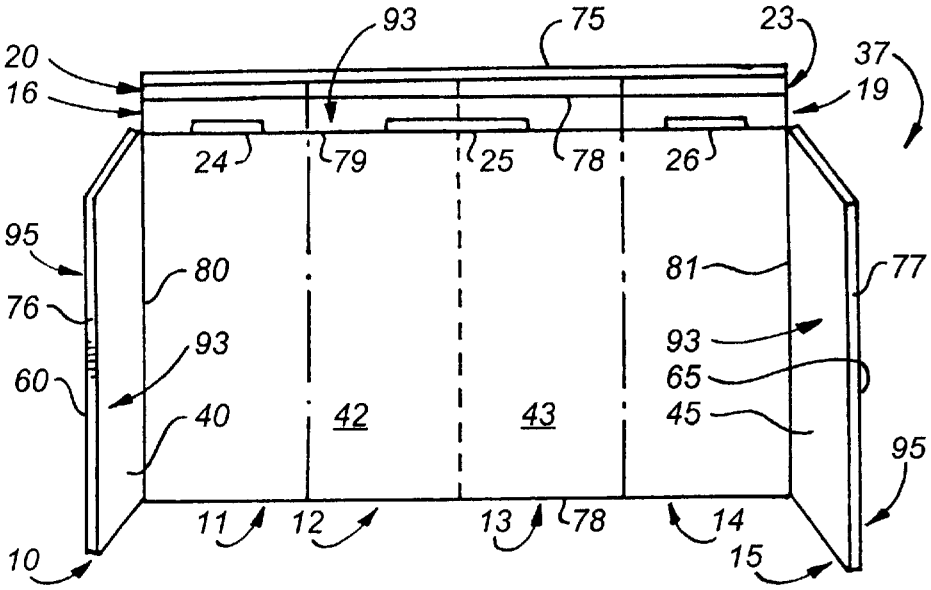
FIG. 3 is a perspective view of the laminate board of FIG. 2 when the board is being refolded into a decor unit configuration.

Lines of weakening 30 to 36 are formed in board 37. Lines of weakening 30 to 36 can be formed with perforations are by any desired method. It is, however, presently preferred that lines of weakening 30 to 36 be formed by die cutting board 37. The method by which the die cuts are formed are critical in the practice of the invention because the die cuts perform the dual function of enabling board 37 to be folded into the compact configuration of FIG. 1 and of enabling board 37 to be unfolded from the configuration of FIG. 1 and to be refolded into the decor unit illustrated in FIGS. 4 and 8. In FIGS. 2 and 7, parallel spaced-apart die cut lines 31, 32, 33 extend between and are normal to parallel spaced apart upper 75 and lower 78 edges. Die cut line 30 is parallel to lines 31 to 33 and extends upwardly from lower edge 78 to the top of panel 10 in FIG. 2. Die cut line 34 is parallel to lines 30 to 33 and extends upwardly from lower edge 78 to the top of panel 15 in FIG. 2. Parallel die cut lines 35 and 36 are each normal to lines 31 to 33.

Die cut lines 31 and 33 each extend through layer 93 and core 94, but not through layer 95. Die cut lines 30, 32, 34, 35, 36 each extend through layer 95 and core 94, but not through layer 93.

Lines 30 to 34 alternate with respect to whether each line 30 to 34 extends through layer 93 or through opposing spaced apart layer 95, along with extending through core 94. Consequently, line 30 extends through layer 93 and not layer 95, line 31 extends through layer 95 and not layer 93, line 32 extends through layer 93 and not layer 95, etc. This alternating method of die cutting through the front and back outer layers 93 and 95, respectively, enables board 37 to be folded in zig-zag fashion into the compact storage configuration of FIG. 1 and also enables board 37 to be folded into the decor unit illustrated in FIG. 4. Certain of lines of weakening 30 to 36 are folded in the configuration of FIG. 1 but are not folded in the configuration of FIG. 4, and vice-versa. For example, line of weakening 32 is folded in FIG. 1 but is not folded in FIG. 4. This contrasts with typical prior art boards in which all of the lines of weakening are not folded in a storage configuration but are folded when the board is configured into a decor unit. The die-cutting procedure just described enables board 37 to be folded and unfolded in a zig-zag configuration in the manner illustrated in FIGS. 1 and 6.

In FIG. 5, pliable fabric cover 100 includes opposite ends 122, 123 and includes flap 102 attached to and depending from pocket 101. The bottom edge of pieces 105 to 110 of VELCRO (TM) hook fabric are attached to the upper edge of the back 121 of pocket 101. Pieces 111 to 114 of VELCRO (TM) loop fabric are attached to the upper inner edge of the front 120 of pocket 101. Pieces 103 and 104 of VELCRO (TM) loop fabric are attached in FIG. 5 to the outer back surface of flap 102. When cover 100 is mounted on board 37, piece 107 is attached to piece 111, piece 108 is attached to piece 112, piece 109 is attached to piece 113, piece 110 is attached to piece 114, piece 105 is attached to piece 103, and piece 106 is attached to piece 104. When cover 100 is mounted on board 37, piece 107 extends through opening 24, pieces 108 and 109 extend through opening 25, and piece 110 extends through opening 26. In addition, when cover 100 is mounted on board 37, back 121 is adjacent and contacts at least in part layer 95, front 120 is adjacent and contacts at least in part layer 93, and flap 102 is adjacent and contacts at least in part the portions of layer 95 comprising in part panels 16 to 23.

Figure 8:
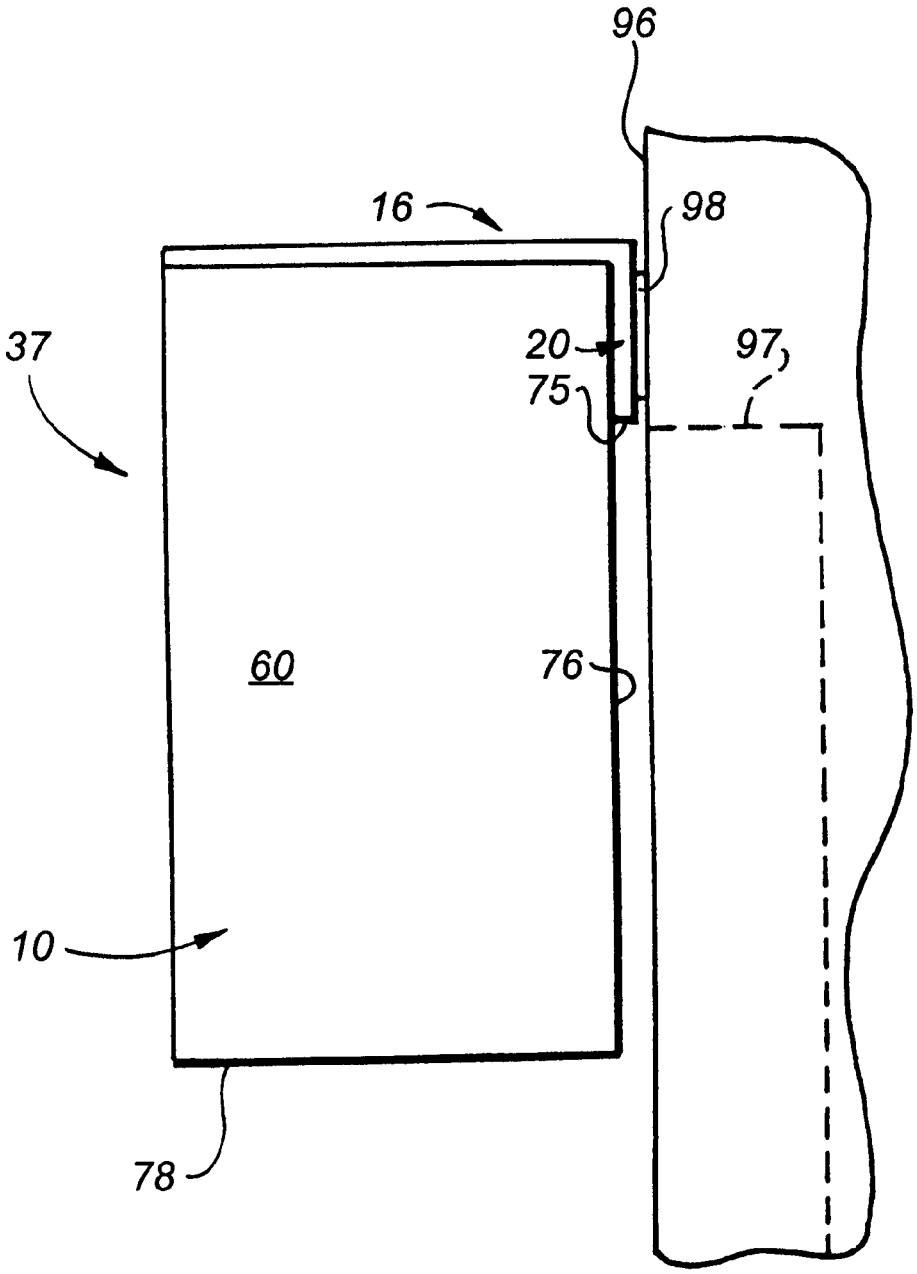
FIG. 8 is an elevation view illustrating mounting the assembled board of FIG. 4 on a wall.

In use, board 37 is unfolded from the configuration of FIG. 1 into the flat configuration of FIG. 2. End panels 15 and 10 are folded in the directions indicated by arrows A and B, respectively, to form parallel creases or fold lines 80 and 81 illustrated in FIG. 3. Panels 46 to 53 are folded in the direction indicated by arrow C to form parallel creases or fold lines 78 and 79 illustrated in FIG. 3. When the folding of panels 10, 15, 20 to 23 is complete, the decor unit of FIG. 4 results. Adhesive strips 98, indicated by rectangular dashed line patterns on fronts panels 20 to 23, can be utilized to attached the decor unit of FIG. 4 to a wall 96 in the manner indicated in FIG. 8. In FIG. 8, dashed line 97 is a window recessed in wall 98 in conventional fashion. Since panels 20 to 23 overlap edges 76 to 77 in FIG. 4, adhesive or other fastening means is not presently utilized to maintain board 37 in the decor unit configuration illustrated in FIG. 4. In FIG. 4, panels 20 to 23 bear against edges 76 to 77 and function to hold board 37 in the configuration of FIG. 4 when the decor unit of FIG. 4 is mounted against a wall 96 or other vertical surface in the manner illustrated in FIG. 8. In addition, when cover 100 is mounted on board 37, cover 100 functions to maintain the configuration of board 37. Adhesive or other fastening means can be utilized to attach selected appropriate panels of the decor unit of FIG. 4 to one another to maintain the decor unit in the configuration illustrated in FIG. 4.

The mounting of cover 100 is initiated when board 37 is in the configuration illustrated in FIG. 2. This is accomplished by slipping panels 10 to 15 of board 37 into pocket 101, by threading fabric pieces 107 to 110 through apertures 24 to 26 respectively, and by attaching piece 107 to piece 111, attaching piece 108 to piece 112, attaching piece 109 to piece 113, and attaching piece 110 to piece 114. Layer 95 of board 37 is adjacent the back 121 of pocket 101. Layer 93 of board 37 is adjacent the front 120 of pocket 101. The portion of layer 95 comprising the back of panels 16 to 23 is adjacent the flap 102 of cover 100.

After panels 10 to 15 are inserted and secured in pocket 101 in the manner just described, board 37 is folded into the configuration shown in FIG. 4. At that point piece 105 is attached to piece 103 and piece 106 is attached to piece 104 to complete mounting cover 100 on board 37. As would be appreciated by those of skill in the art, cover 100 can be removed from and reinstalled on board 37 even after board 37 is mounted to a wall 96 in the manner illustrated in FIG. 8.

The decor unit illustrated in FIG. 4 can, with or without cover 100 or paint or some other covering material, be utilized to function other than as a wall decoration. For example, the decor unit can be placed on the floor to serve as a table or stand. Further, board 37 can be utilized in the flat configuration of FIG. 2 as a headboard, wall decoration, etc.

Having described my invention in such terms as to enable those of skill in the art to make and use it, and having described the presently preferred embodiments thereof.

I claim:

1. In combination with a vertically oriented wall of a building structure, a decor unit including a) a laminate board including
(i) a front layer,
(ii) an outer front surface on said front layer,
(iii) a back layer,
(iv) an outer back surface on said back layer,
(v) at least one stiffening layer intermediate said front and back layers, said front layer, back layer and stiffening layer coterminating at a common peripheral edge,
(vi) at least one frontal line of weakening extending through said front layer and said stiffening layer,
(vii) a first pair of opposing abutting surfaces contacting and conforming to each other along said frontal line of weakening, each of said abutting surfaces extending from and being at an angle to said back layer,
(viii) at least one rear line of weakening extending through said back layer and said stiffening layer,
(ix) a second pair of opposing abutting surfaces contacting and conforming to each other along said rear line of weakening, each of said second pair of abutting surface extending from and being at an angle to said back layer, said frontal and rear lines of weakening being parallel and shaped and dimensioned such that said laminate board is foldable along said lines of weakening in zig-zag fashion, said frontal and rear lines of weakening being foldable only away from said lines of weakening;

(b) a fabric cover on said laminate board, said cover including
(i) a pocket fitting over a portion of said laminate board,
(ii) a flap attached to said pocket, and
(iii) fastening means on said flap and said pocket securing said flap to said pocket and securing said cover on said laminate board; and, (c) fastening means securing the decor unit to the wall.

2. In combination with a vertically oriented wall of a building structure, a decor unit including (a) a vertically oriented front portion (11, 12, 13, 14) spaced away from the wall, said front portion including a lower edge, an outer surface and an inner surface, said inner surface facing the wall;

(b) vertically oriented, spaced apart side portions (10, 15) each connected to said front portion and extending from said front portion toward the wall and each including a lower edge, an inside surface and an outside surface, each of said inside surfaces facing the other of said inside surfaces;

(c) a horizontally oriented upper portion (16, 17, 18, 19) connected to said front portion and extending from said front portion toward the wall, said upper portion including a top surface and a downwardly facing bottom surface;

(d) a pliable fabric cover including
(i) a single pocket for mounting said cover on said decor unit, said pocket having a closed bottom and having a mouth positioned adjacent said upper portion,
(ii) flap means attached to said mouth and including a distal portion spaced apart from said mouth, and
(iii) securing means fastening said distal portion of said flap means to said pocket,
said pocket substantially covering said inner and outer surfaces of said front portion and said inside and outside surfaces of said side portions,
said flap means extending over, contacting, and covering said top surface of said upper portion,
said pocket slidably fitting upwardly over said front portion and said side portions toward said upper portion and extending around and conforming to said front portion and said side portions, and
said bottom of said pocket extending along said lower edges of said front portion and said side portions; and, (e) fastening means securing the decor unit to the wall.

3. A decor kit for assembly and for mounting on a vertically oriented wall of a building structure, said kit including (a) a folded laminate board including
(i) a front layer,
(ii) an outer front surface on said front layer,
(iii) a back layer,
(iv) an outer back surface on said back layer,
(v) at least one stiffening layer intermediate said front and back layers, said front layer, back layer and stiffening layer coterminating at a common peripheral edge,
(vi) a front portion including an inner surface, an outer surface, a lower edge, an upper edge, and at least two parallel folded sections (11, 12, 13, 14),
(vii) at least one side portion (10, 15) connected to said front portion and including an inside surface, an outside surface, and a lower edge,
(viii) an upper portion connected to said upper edge of said front portion and including a top surface and at least two parallel folded sections (16, 17, 18, 19),
(ix) at least one frontal fold (90) in said front layer of said front portion and said upper portion, said fold extending between said folded sections of said upper portion and extending between said folded sections of said front portion,
(x) a first pair of opposing surfaces along and extending outwardly from said fold line and generally lying in a common plane normal to said parallel folded sections of said front portion and said upper portion,
(xi) at least one rear fold (91) in said rear layer, parallel to said frontal fold and extending between said front portion and said side portion,
(xii) a second pair of opposing surfaces along and extending outwardly from said rear fold and generally lying in a common plane normal to said parallel folded sections of said front portion and said upper portion, (xiii) a first frontal line of weakening (35) normal to said frontal fold and said rear fold and extending intermediate said upper portion and said front portion and permitting said upper portion to be folded to a position at an angle to said front portion, (xiv) a third pair of opposing abutting surfaces contacting and conforming to each other along said first frontal line of weakening such that said upper portion and said front portion can only be folded away from said line of weakening, each of said third pair of abutting surfaces extending from and at an angle to said back layer, said side portion and said sections of said front portion and said upper portion being folded in zig-zag fashion with each section of said upper portion lying in a common plane with one of said sections of said front portion, said folds and line of weakening permitting said folded laminate board to be unfolded into an unfolded configuration with said side portion at an angle to said front portion and with said upper portion at an angle to said front portion and said side portion;

(b) a fabric cover for said laminate board, said cover including (i) a single pocket for slidably mounting said cover on said laminate board over said side portion and said front portion when said laminate board is in said unfolded configuration, said pocket having a closed bottom and having a mouth terminating adjacent said upper portion when said fabric cover is mounted on said laminate board in said unfolded configuration, (ii) flap means attached to said mouth to extend over said upper portion when said cover is mounted on said laminate board in said unfolded configuration, said flap means including a distal portion spaced apart from said mouth; and, (iii) securing means to fasten said distal portion of said flap means to said pocket, said pocket and said flap means being shaped and dimensioned such that when said cover is mounted on said laminate board in said unfolded configuration, said pocket substantially covers said inner and outer surfaces of said front portion and said inside and outside surfaces of said side portion, said flap means extends over, contacts, and covers said top surface of said upper portion, said pocket slidably fits upwardly over said front portion and said side portion toward said upper portion and extends around and conforms to said front portion and said side portion, and said bottom of said pocket extends along said lower edges of said front portion and said side portion; and, (c) fastening means to secure the decor unit to the wall.

4. A method for assembling and mounting on a wall a decor kit, including the steps of (a) providing a decor kit including (i) a folded laminate board including (A) a front layer, (B) an outer front surface on said front layer, (C) a back layer, (D) an outer back surface on said back layer, (E) at least one stiffening layer intermediate said front and back layers, said front layer, back layer and stiffening layer coterminating at a common peripheral edge, (F) a front portion including an inner surface, an outer surface, a lower edge, an upper edge, and at least two parallel folded sections (11, 12, 13, 14), (G) at least one side portion (10, 15) connected to said front portion and including an inside surface, an outside surface, and a lower edge, (H) an upper portion connected to said upper edge of said front portion and including a top surface and at least two parallel folded sections (16, 17, 18, 19), (I) at least one frontal fold (90) in said front layer of said front portion and said upper portion, said fold extending between said folded sections of said upper portion and extending between said folded sections of said front portion, (J) a first pair of opposing surfaces along and extending outwardly—from said fold and generally lying in a common plane normal to said parallel folded sections of said front portion and said upper portion, (K) a first rear fold (91) in said rear layer, parallel to said frontal fold and extending between said front portion and said side portion, (L) a second pair of opposing surfaces along and extending outwardly from said rear fold and generally lying in a common plane normal to said parallel folded sections of said front portion and said upper portion, (M) a first frontal line of weakening (35) normal to said frontal fold and said rear fold and extending intermediate said upper portion and said front portion and permitting said upper portion to be folded to a position at an angle to said front portion, (N) a third pair of opposing abutting surfaces contacting and conforming to each other along said first frontal line of weakening such that said upper portion and said front portion can only be folded away from said line of weakening, each of said third pair of abutting surfaces extending from and at an angle to said back layer, said side portion and said sections of said front portion being folded in zig zag fashion with each section of said upper portion lying in a common plane with one of said sections of said front portion, said folds and line of weakening permitting said folded laminate board to be unfolded into an unfolded configuration with said side portion at an angle to said front portion and with said upper portion at an angle to said front portion and said side portion;

(ii) a fabric cover for said laminate board, said cover including (A) a single pocket for slidably mounting said cover on said laminate board over said side portion and said front portion when said laminate board is in said unfolded configuration, said pocket having a closed bottom and having a mouth terminating adjacent said upper portion when said fabric cover is mounted on said laminate board in said unfolded configuration, (B) flap means attached to said mouth to extend over said upper portion when said cover is mounted on said laminate board in said unfolded configuration, said flap means including a distal portion spaced apart from said mouth; and, (C) securing means to fasten said distal portion of said flap means to said pocket, said pocket and said flap means being shaped and dimensioned such that when said cover is mounted on said laminate board in said unfolded configuration, said pocket substantially covers said inner and outer surfaces of said front portion and said inside and outside surfaces of said side portion, said flap means extends over, contacts, and covers said top surface of said upper portion, said pocket slidably fits upwardly over said front portion and said side portion toward said upper portion and extends around and conforms to said front portion and said side portion, and said bottom of said pocket extends along said lower edges of said front portion and said side portion; and, (iii) fastening means to secure the decor unit to the wall, (b) unfolding said laminate board to said unfolded configuration;

(c) using said fastening means to mount said unfolded laminate board on the wall;

(d) sliding said fabric cover onto said unfolded, mounted laminate board such that said pocket substantially covers said inner and outer surfaces of said front portion and said inside and outside surfaces of said side portion, said flap means extends over, contacts, and covers said top surface of said upper portion, said pocket slidably fits upwardly over said front portion and said side portion toward said upper portion and extends around and conforms to said front portion and said side portion, and said bottom of said pocket extends along said lower edges of said front portion and said side portion; and, (e) securing detachably said distal end of said flap to said pocket with said securing means.

* * * * *